US007743972B2

(12) United States Patent
Fogle

(10) Patent No.: US 7,743,972 B2
(45) Date of Patent: Jun. 29, 2010

(54) CARTON WITH DISPENSER

(75) Inventor: James C. Fogle, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 1129 days.

(21) Appl. No.: 11/174,232

(22) Filed: Jul. 1, 2005

(65) Prior Publication Data

US 2007/0000982 A1 Jan. 4, 2007

(51) Int. Cl.

| | |
|---|---|
| ***B65D 5/00*** | (2006.01) |
| ***B65D 5/72*** | (2006.01) |
| ***B65D 25/04*** | (2006.01) |
| ***B65D 17/00*** | (2006.01) |
| ***A47F 1/04*** | (2006.01) |

(52) U.S. Cl. ..... 229/120.18; 229/122.1; 229/122; 229/242; 221/302; 221/305

(58) Field of Classification Search ..... 229/120.18, 229/122.1, 122, 242; 221/302, 305
See application file for complete search history.

(56) References Cited

U.S. PATENT DOCUMENTS

| | | | | | |
|---|---|---|---|---|---|
| 1,724,224 | A | * | 8/1929 | Schroeder | 493/74 |
| 1,915,341 | A | * | 6/1933 | Walker et al. | 229/122.1 |
| 1,986,101 | A | * | 1/1935 | Brodsky | 229/242 |
| 2,005,924 | A | * | 6/1935 | Wilson | 229/242 |
| 2,067,749 | A | * | 1/1937 | Zimmerman et al. | 221/311 |
| 2,175,600 | A | | 10/1939 | Greco | |
| RE23,670 | E | * | 6/1953 | Currivan | 206/420 |
| 3,182,792 | A | * | 5/1965 | Viltrakis | 206/449 |
| 3,300,115 | A | * | 1/1967 | Schauer | 221/305 |
| 3,356,281 | A | * | 12/1967 | Buttery | 229/120.12 |
| 3,568,911 | A | * | 3/1971 | Bebout | 206/738 |
| 4,815,609 | A | * | 3/1989 | Kiedaisch | 229/235 |
| 4,921,105 | A | * | 5/1990 | Culbreth | 229/117.16 |
| 6,015,084 | A | * | 1/2000 | Mathieu et al. | 229/122.32 |
| 6,123,222 | A | | 9/2000 | Richiger et al. | |
| 2004/0195299 | A1 | * | 10/2004 | Petrelli et al. | 229/120.15 |
| 2005/0103652 | A1 | | 5/2005 | Wilkins | |
| 2006/0283927 | A1 | * | 12/2006 | Walsh et al. | 229/122.1 |

FOREIGN PATENT DOCUMENTS

| | | | |
|---|---|---|---|
| DE | 93 07 457.3 | | 7/1993 |
| EP | 399936 | A1 * | 11/1990 |
| GB | 2 287 697 | A | 9/1995 |
| GB | 2 408 039 | A | 5/2005 |
| WO | WO 9116246 | A2 * | 10/1991 |
| WO | WO 2005/051781 | A1 | 6/2005 |

* cited by examiner

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton comprises a divider panel that connects a front panel of the carton to a back panel. The lower edge of the divider panel is offset from the bottom panel, and therefore is less likely to buckle or bend when the carton is subjected to axial compression. The divider panel therefore provides greater axial stiffness and strength to the carton.

29 Claims, 11 Drawing Sheets

CARTON WITH DISPENSER

BACKGROUND

Dispensing cartons are known. Known cartons have a box structure and a dispenser opening at the bottom of the carton. Items may be stacked within the carton and withdrawn through the dispensing opening. Dispensing cartons may also be provided with an interior divider panel that divides the interior of the carton into vertical columns. The divider panel allows articles to be stacked within separate columns within the carton, and provides added strength when the carton is subjected to axial loads.

Known divider panels do not provide optimal strength, however, because as the carton is compressed and the divider panel presses against the bottom panel of the carton, the divider panel has a tendency to bend or deflect at its lower edge. Deflection of part of the divider panel outside of the plane of the divider panel reduces its axial stiffness, which in turn reduces the stiffness of the carton under compressive loads. Because dispensing cartons are typically stacked in several tiers during shipping and storage, strength in compression is critical.

SUMMARY

According to a first embodiment, a carton comprises a back panel, a first side panel, a front panel, a second side panel, a bottom panel, a top panel, and a divider panel. The divider panel is disposed within an interior of the carton, and connects the front panel to the back panel. The lower edge of the divider panel may be at least substantially offset from the bottom panel. In some embodiments, the divider panel may be completely offset from the bottom panel.

According to the first embodiment, axial compression of the carton is less likely to result in bending or buckling of the divider panel. The divider panel therefore provides greater axial stiffness to the carton. Also, the divider panel can include a relief area that allows better access to articles held within the carton.

Other aspects, features, and details of the present invention can be more completely understood by reference to the following detailed description of preferred embodiments taken in conjunction with the drawings and from the appended claims.

BRIEF DESCRIPTION OF THE DRAWING FIGURES

DETAILED DESCRIPTION

Figure 1:
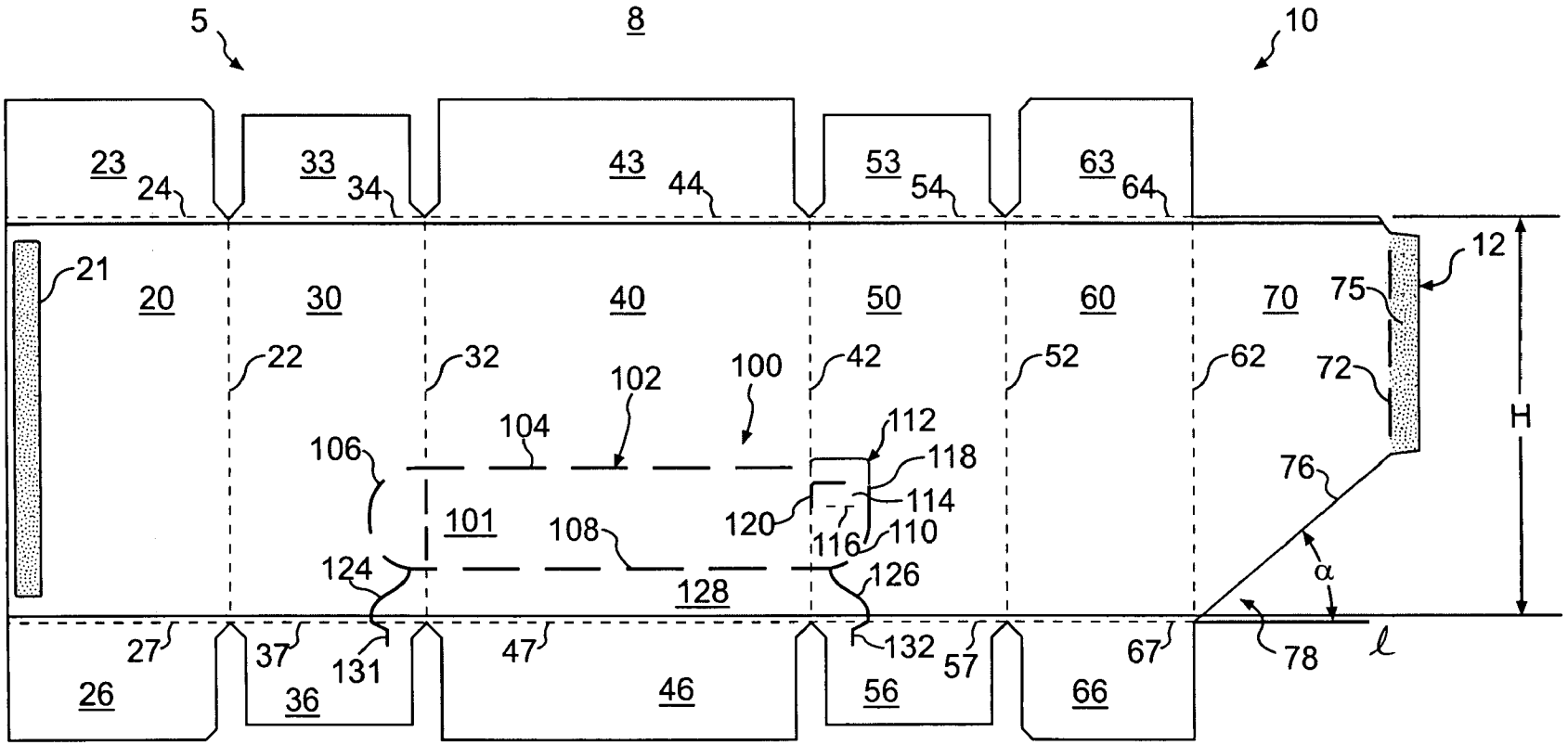
FIG. 1 is a plan view of a blank used to form a carton according to a first embodiment.

FIG. 1 is a plan view of a first, interior side 5 of a blank 8 used to form a carton 150 (illustrated in FIG. 5) according to a first embodiment. The first side 5 will be disposed in the interior of the erected carton 150. The blank 8 may have, for example, a two-ply configuration formed from a first sheet 10 adhered to a second sheet 12. For example, the second sheet 12 can have a height H and can be adhered or otherwise secured to a central portion of the first sheet 10. The length of the first and second sheets 10, 12, measured from left to right in FIG. 1, can be substantially equal.

The blank 8 comprises a first back panel 20 foldably connected to a first side panel 30 at a first transverse fold line 22, a front panel 40 foldably connected to the first side panel 30 at a second transverse fold line 32, a second side panel 50 foldably connected to the front panel 40 at a third transverse fold line 42, a second back panel 60 foldably connected to the second side panel 50 at a fourth transverse fold line 52, and a divider panel 70 foldably connected to the second back panel 60 at a fifth transverse fold line 62. The divider panel 70 may be foldably connected to an adhesive flap 75 at a sixth transverse fold line 72. The fold line 72 may include, for example, one or more spaced cuts to facilitate folding at the fold line.

The first back panel 20 is foldably connected to a first top flap 23 at a first top longitudinal fold line 24, and foldably connected to a first bottom flap 26 at a first bottom longitudinal fold line 27. The first side panel 30 is foldably connected to a second top flap 33 at a second top longitudinal fold line 34, and foldably connected to a second bottom flap 36 at a second bottom longitudinal fold line 37. The front panel 40 is foldably connected to a third top flap 43 at a third top longitudinal fold line 44, and foldably connected to a third bottom flap 46 at a third bottom longitudinal fold line 47. The second side panel 50 is foldably connected to a fourth top flap 53 at a fourth top longitudinal fold line 54, and foldably connected to a fourth bottom flap 56 at a fourth bottom longitudinal fold line 57. The second back panel 60 is foldably connected to a fifth top flap 63 at a fifth top longitudinal fold line 64, and foldably connected to a fifth bottom flap 66 at a fifth bottom longitudinal fold line 67. The third bottom longitudinal fold line 47 may include, for example, one or more cuts (not shown) to facilitate bending at the fold line. The flaps 23, 33, 43, 53, 63 extend along a first or top marginal area of the blank 8, and the flaps 26, 36, 46, 56, 66 extend along a second or bottom marginal area of the blank 8.

The fold lines 24, 34, 44, 54, 64 may be collinear, and are formed in the first sheet 10, extending parallel to a top edge of the second sheet 12. The fold lines 26, 36, 46, 56, 66 may also be collinear, formed in the first sheet 10, and extending parallel to a bottom edge of the second sheet 12. When the carton 150 is erected, the flaps 23, 33, 43, 53, 63 close a top opening of the carton 150, and the flaps 26, 36, 46, 56, 66 close a bottom opening of the carton 150.

A dispenser 100 is formed in the blank 8 by a dispenser cut pattern 102. The dispenser cut pattern 102 includes a longitudinally extending upper portion 104, a first arcuate side portion 106, a longitudinally extending lower portion 108, a second arcuate side portion 110, and an access cutout 112 located directly above an access flap 114. The access flap 114 is defined by first and second cut lines 118, 120 and is foldable at a fold line 116. The portions 104, 106, 108, 110 and the access cutout 112 define an upper dispenser flap 101 of the dispenser 100.

The dispenser cut pattern 102 also includes first and second arcuate base cut lines 124, 126 and first and second pivot cut lines 131, 132. The first and second base cut lines 124, 126 extend downwardly from the lower portion 108 to the fold lines 37, 57, respectively. The first pivot cut line 131 extends from the fold line 37, at a point adjacent to the first base cut line 124, into the second bottom flap 36. The second pivot cut line 132 extends from the fold line 57, at a point adjacent to the second base cut line 126, into the fourth bottom flap 56. The base cut lines 124, 126 and the pivot cut lines 131, 132 define a pivotable bottom flap 128 of the dispenser 100. The cuts forming the dispenser cut pattern 102 may extend, for example, through the entire thickness of the blank 8.

The divider panel 70 has a lower edge 76 that may be inclined at an angle $\alpha$ with respect to an extension line l of the fold lines 27, 37, 47, 57, 67. The inclination angle $\alpha$ of the lower edge 76 offsets the lower edge 76 from the line l, creating a relief area 78 beneath the lower edge 76. The offset of the lower edge 76 serves to increase the axial compressive strength of the erected carton 150, as will be discussed in further detail below.

Figure 2:
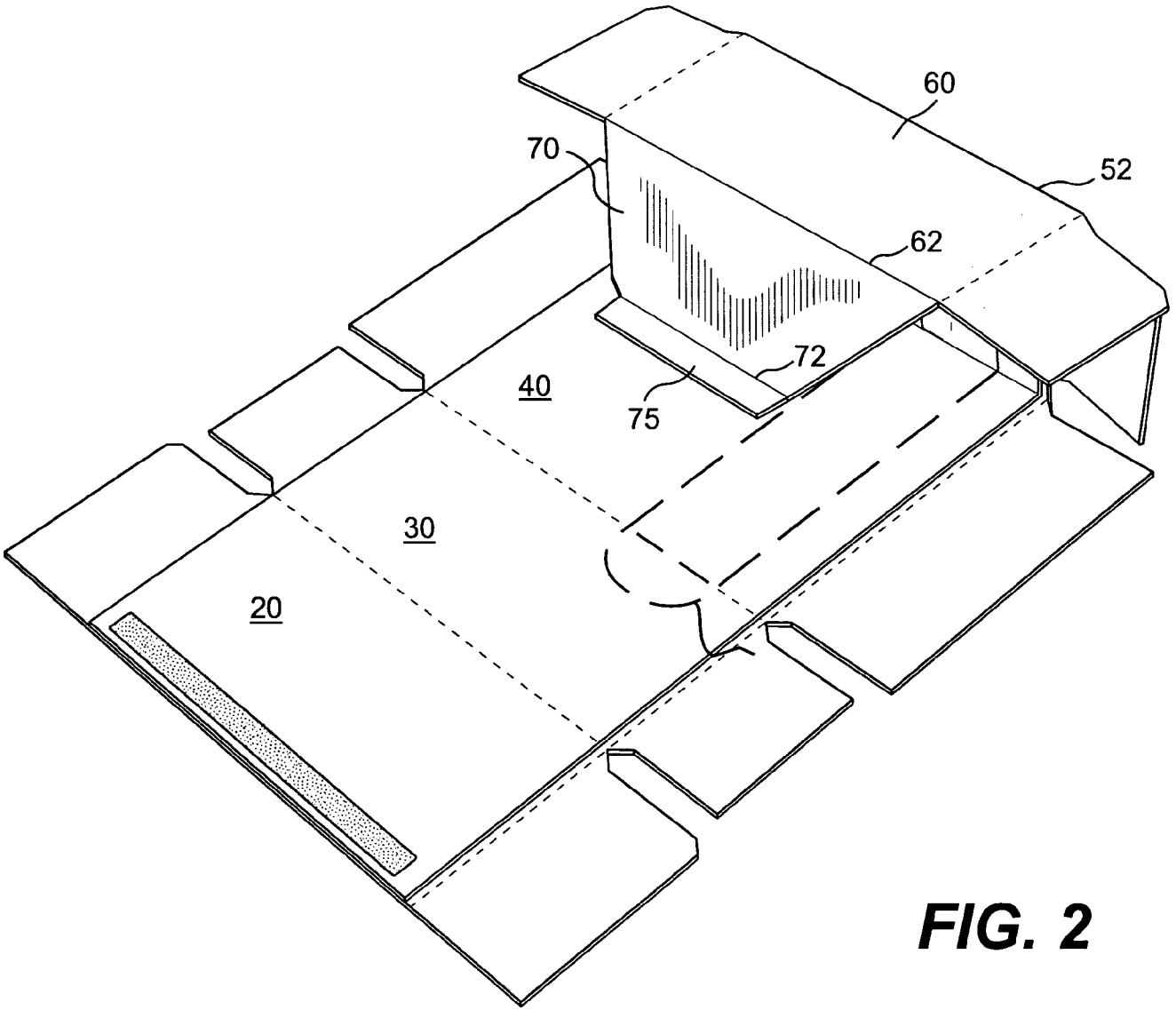
FIG. 2 is a perspective view of an erection step of the carton.

FIG. 2 is a perspective view of the carton 150 partially erected. In practice, the blank may remain generally flat during this stage of erection, with 180 degree folding occurring at the fold line 52. For the purpose of illustrating the final orientation of the divider panel 70, however, FIG. 2 shows the blank folded about fold lines 52, 62 and 72. Prior to folding the blank, glue or other adhesive is applied to the adhesive flap 75 as indicated by the stippling in FIG. 1, and to the first back panel 20 at the location indicated by the stippling 21. The blank is then folded so that the adhesive flap 75 comes into contact with the front panel 40.

Figure 3:
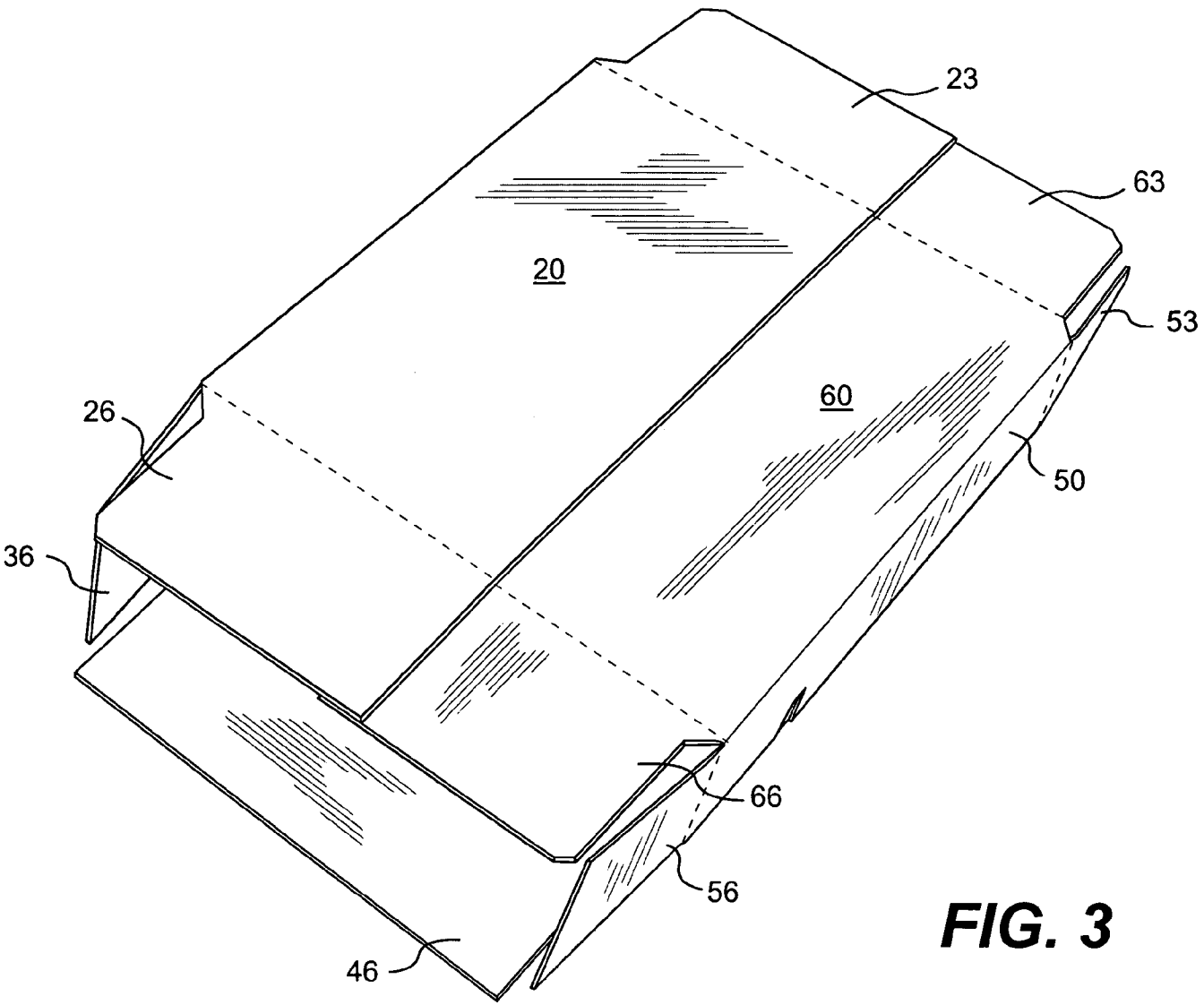
FIG. 3 is a perspective view of an erection step of the carton.

Referring to FIG. 3, the first back panel 20 is folded over so that the glue at location 21 contacts a rear of the second back panel 60, and the folded blank 8 is held in its folded state while the glue dries. The folded blank 8 is then opened to obtain the tubular configuration shown in FIG. 3.

Figure 4:
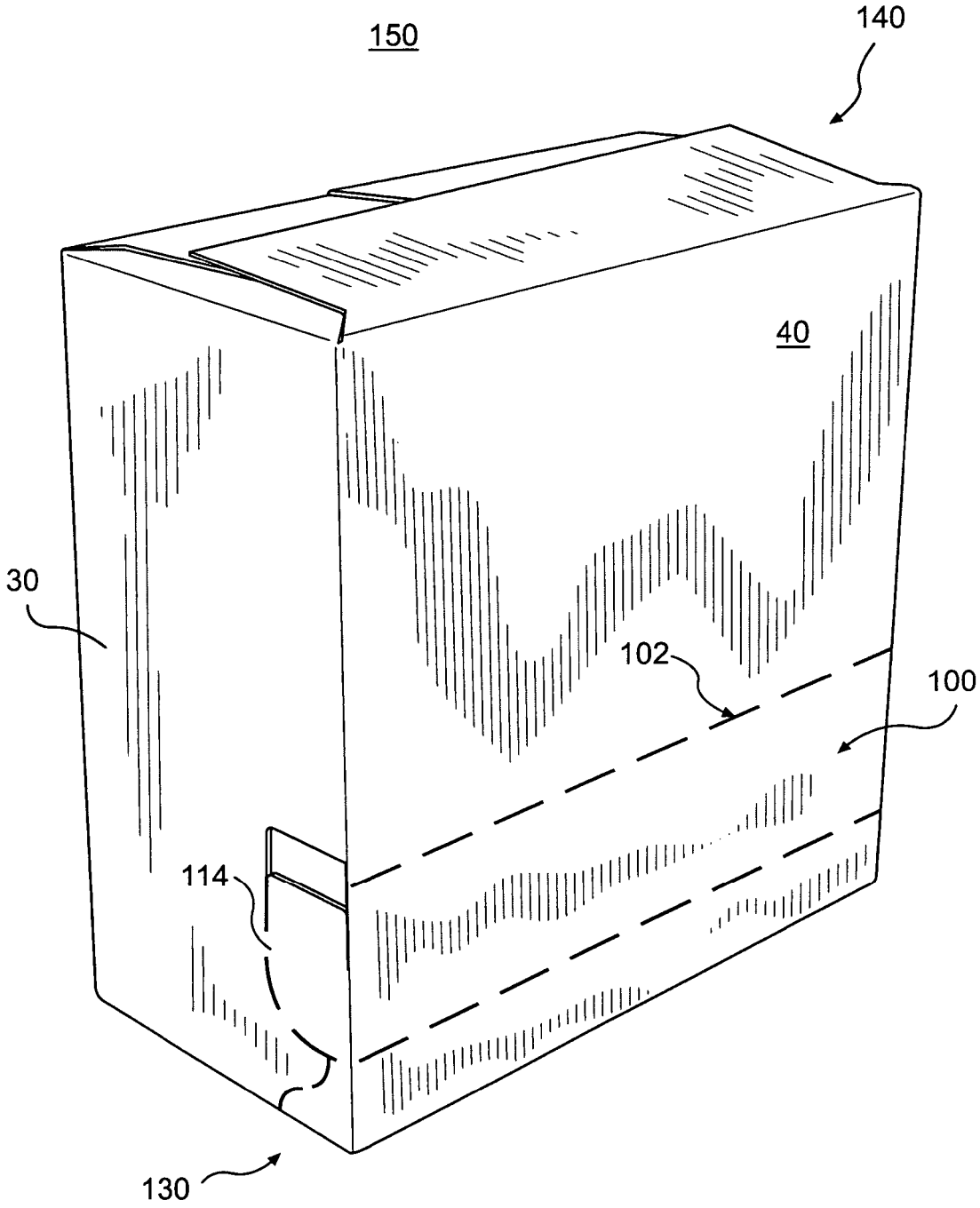
FIG. 4 is a left side perspective view of the erected carton.

Referring to FIGS. 3 and 4, the bottom flaps 26, 36, 46, 56, 66 are folded inwardly and glued in place to form a bottom panel 130, and the top flaps 23, 33, 43, 53, 63 are folded inwardly and glued to form a top panel 140, thereby completing the carton 150. The first and second back panels 20, 60 are joined to form a back panel 160. Dispensable articles (not shown) may be placed in the carton 150 prior to forming either or both of the bottom and top panels 130, 140. In the erected carton 150, the back edge of the divider panel 70 may generally be of the same height as the back panel 160, and the top edge of the divider panel 70 will be adjacent to, and may abut, the top panel 140.

Figure 5:
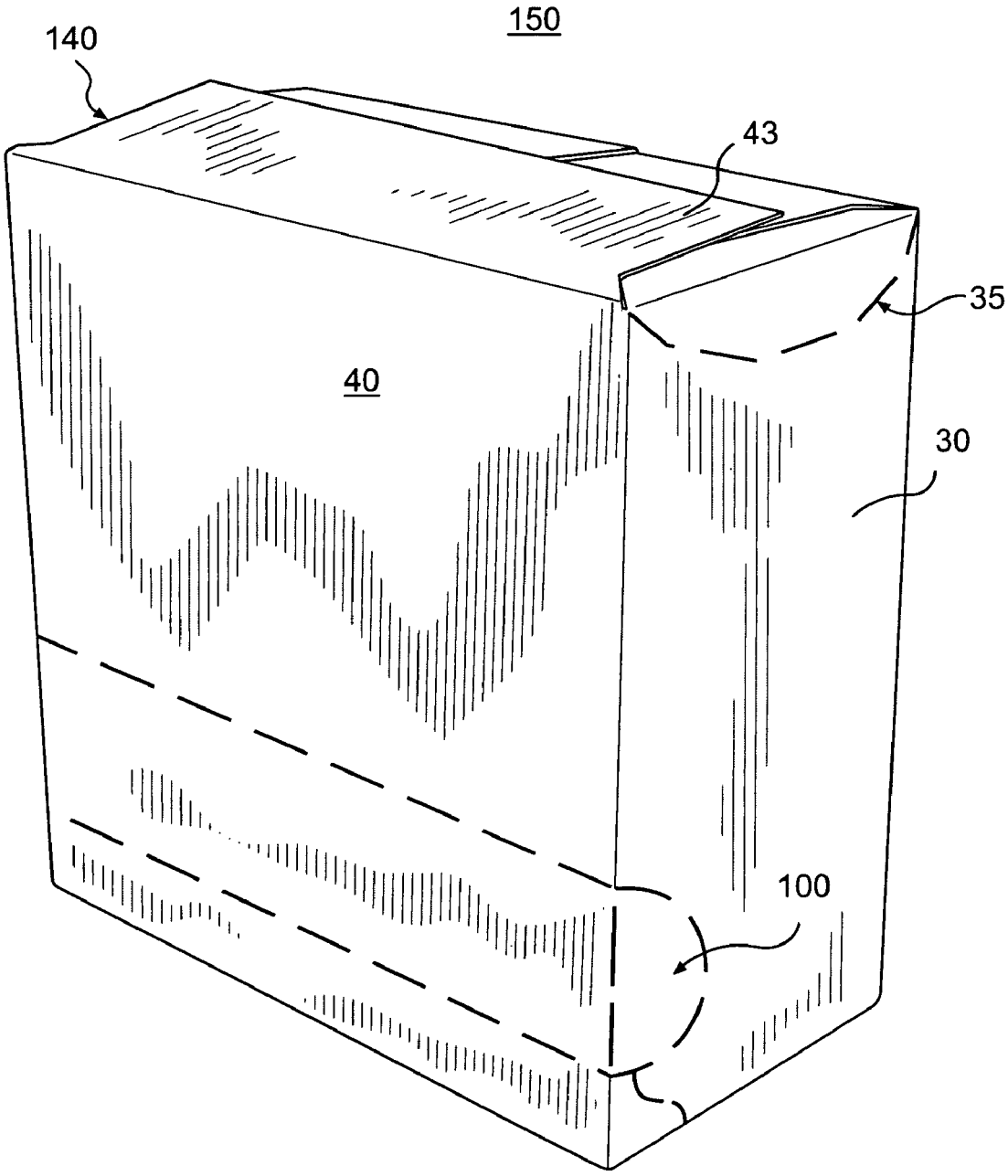
FIG. 5 is a right side perspective view of the erected carton.

FIG. 5 is right side perspective view of the erected carton 150, and illustrates an optional cut pattern 35 in the first side panel 30. The cut pattern 35 may be included to facilitate removal of a top portion of the carton 150, as discussed in detail below.

Figure 6:
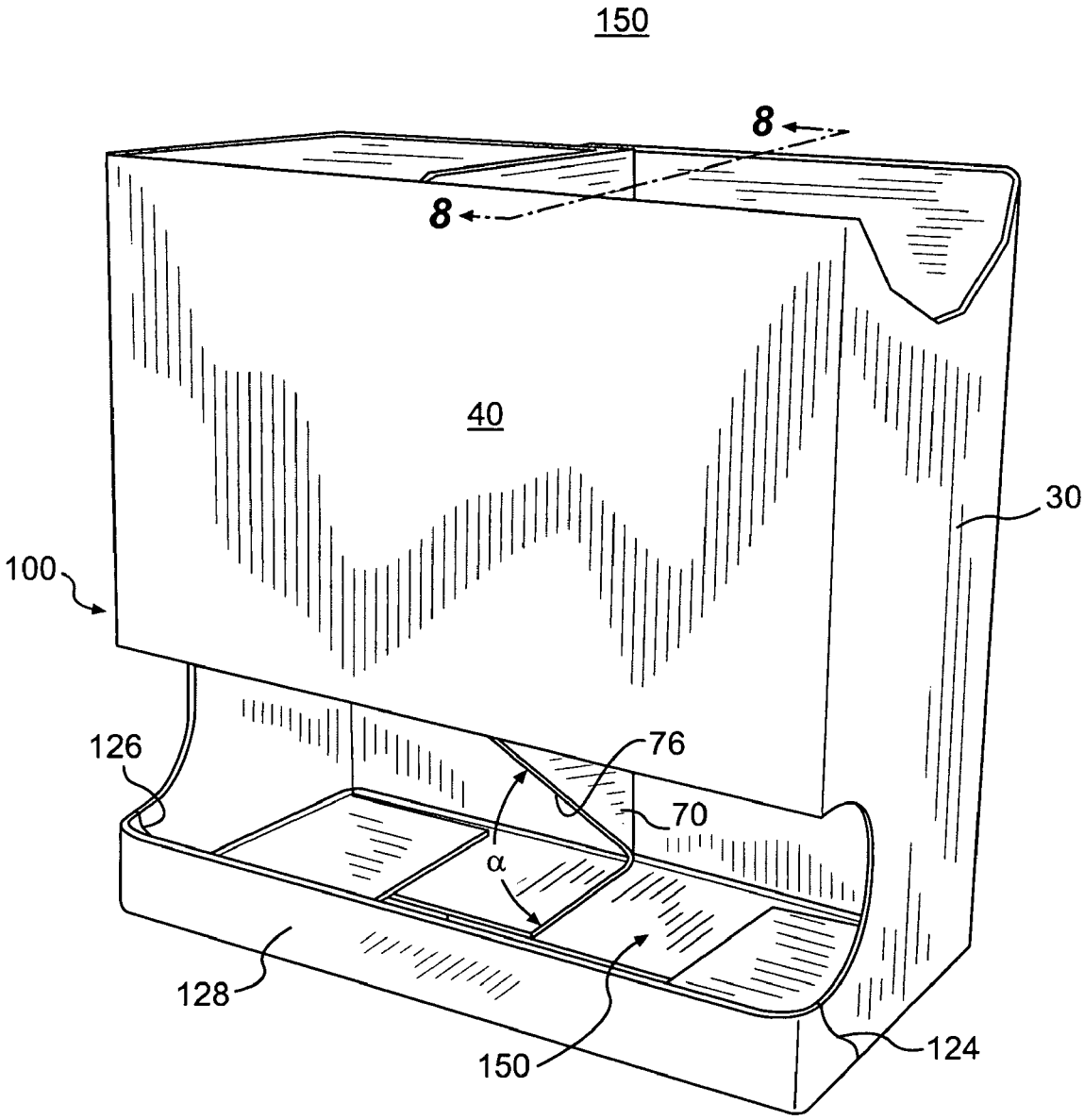
FIG. 6 is a perspective view of the carton with the dispenser partially open and the top panel removed.

Opening of the carton 150 will now be discussed with reference to FIGS. 5 and 6. FIG. 6 illustrates the carton 150 with the top panel 140 removed and the dispenser panel 100 partially opened. The top panel 140 can be removed, for example, by cutting around the top portion of the carton 150 with a cutting tool. Alternatively, a tear strip or other line of disruption (not shown), such as a tear line or a series of cut or score lines, can be formed around an upper perimeter of the carton 150 to facilitate removal of the top of the carton 150. Referring to FIG. 5, removal of the top panel 140 may be begun by pressing in the side panel 30 above the cut pattern 35 to open a hole in the side panel 30. A cutting tool can then be inserted at the opening formed at the cut pattern 35 and the top of the carton 150 can be removed using the cutting tool. Alternatively, if tear lines or other lines of disruption are formed around the carton perimeter, depressing the side panel 30 at the cut pattern 35 allows a person to pull the top of the carton 150 off at the tear lines. Referring to FIG. 6, the dispenser 100 is opened by grasping the access flap 114 (shown in FIG. 4) and tearing along the tear pattern 102.

Figure 7:
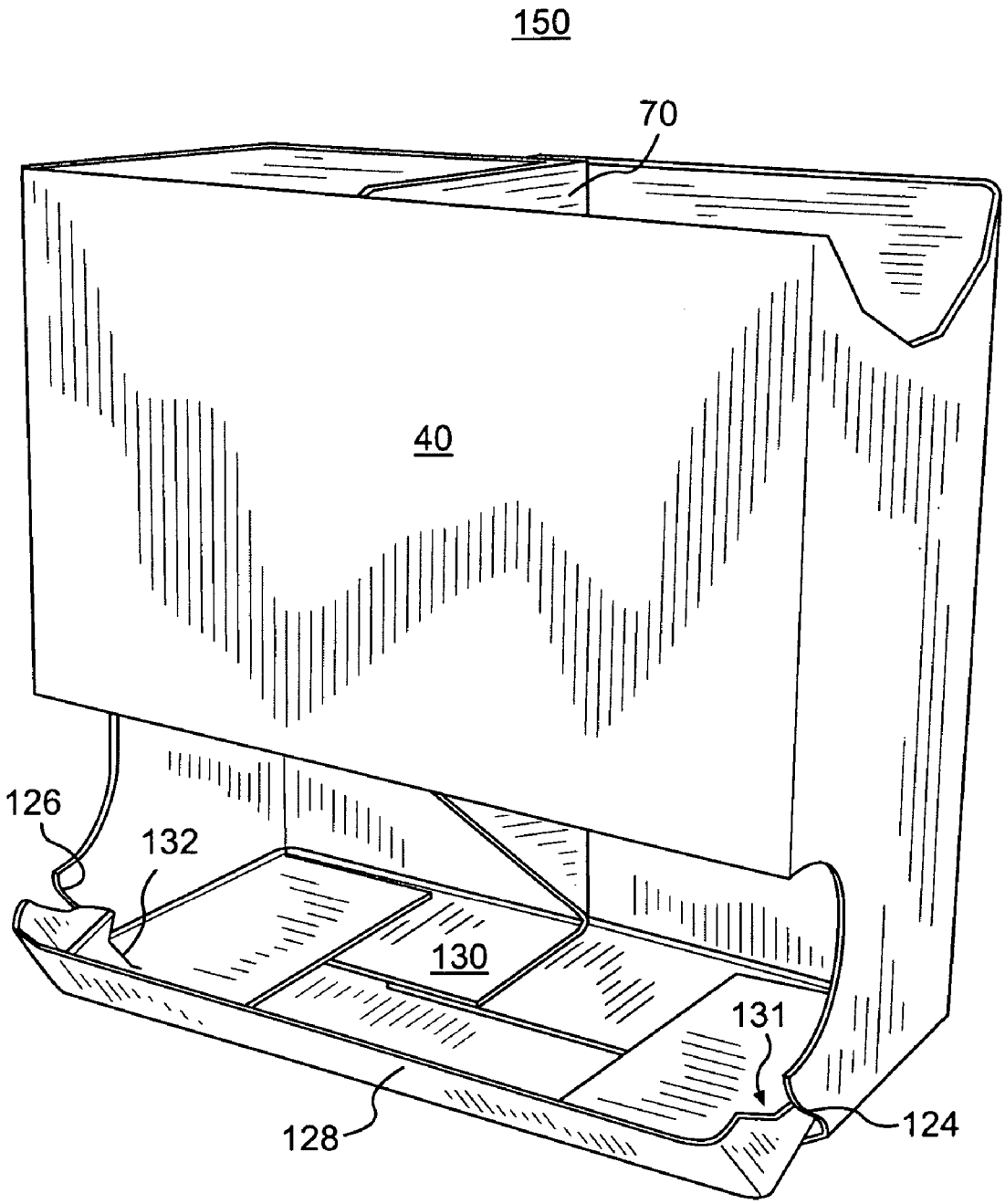
FIG. 7 is a perspective view of the carton with the dispenser fully opened.

Referring to FIG. 7, the dispenser 100 may be further opened by pivoting the bottom flap 128 forward by separating the flap 128 at the first and second base cut lines 124, 126. The flap 128 pivots about the first and second pivot cut lines 131, 132. The pivoted bottom flap 128 effectively widens the opening of the dispenser 100 and allows articles to be more easily removed from the carton 150.

Figure 8:
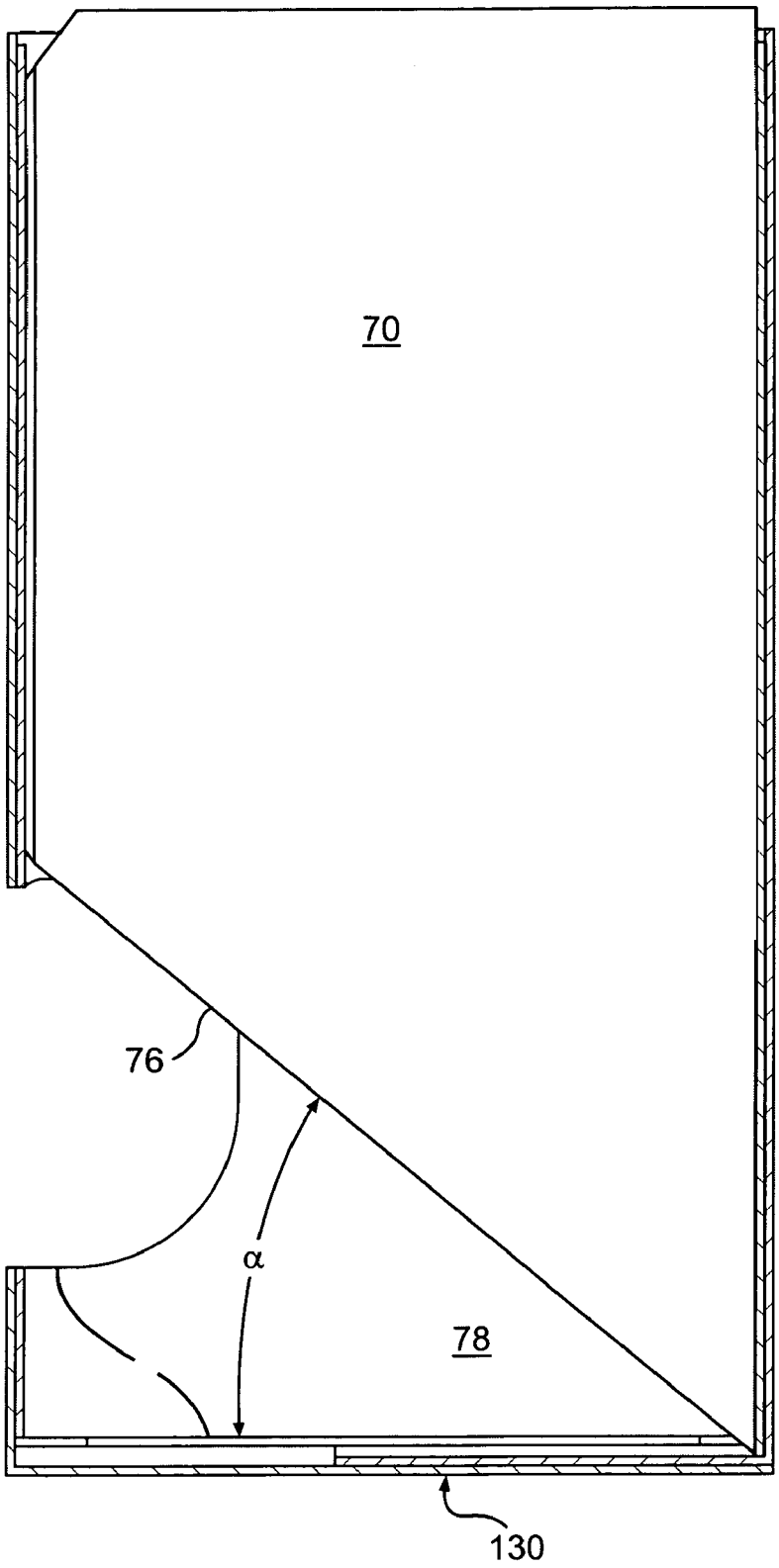
FIG. 8 is a section view taken on line 8-8 in FIG. 6.

FIG. 8 is a section view taken on line 8-8 in FIG. 6. FIG. 8 illustrates the angle of inclination $\alpha$ and the relief area 78 defined between the lower edge 76 of the divider panel 70 and the bottom panel 130. As shown in FIG. 8, at least a majority of the lower edge 76 of the divider panel 70 may be at least substantially out of contact with the bottom panel 130.

The divider panel 70, the back edge of which has a height substantially equal to the height of the carton 150, sustains a portion of axial loads exerted on the carton 150. Because the divider panel 70 is offset from the bottom panel 130, as the carton 150 is axially compressed by forces exerted on the bottom and top panels 130, 140, the divider panel 70 is more likely to remain in an unflexed or unbent state, and therefore resists deflection to either side. The undeflected divider panel 70 provides greater axial stiffness to the carton 150 than a divider panel having a bottom edge out of plane with the remainder of the divider panel. This aspect is especially advantageous when a large number of cartons 150 are vertically stacked, such as for shipping purposes.

According to the present embodiments, the angle of inclination $\alpha$ can be selected to optimize the strength of the carton 150 in compression. The angle $\alpha$ may be in the range of, for example, about 5-75 degrees. In other embodiments, the range may be about 20-60 degrees. In the embodiment shown in FIGS. 1-8, the angle $\alpha$ is about 45 degrees. The angle of inclination $\alpha$ of the lower edge 76 also allows a consumer or other user to more easily remove articles from the dispenser 100 when the dispenser is open.

Figure 9:
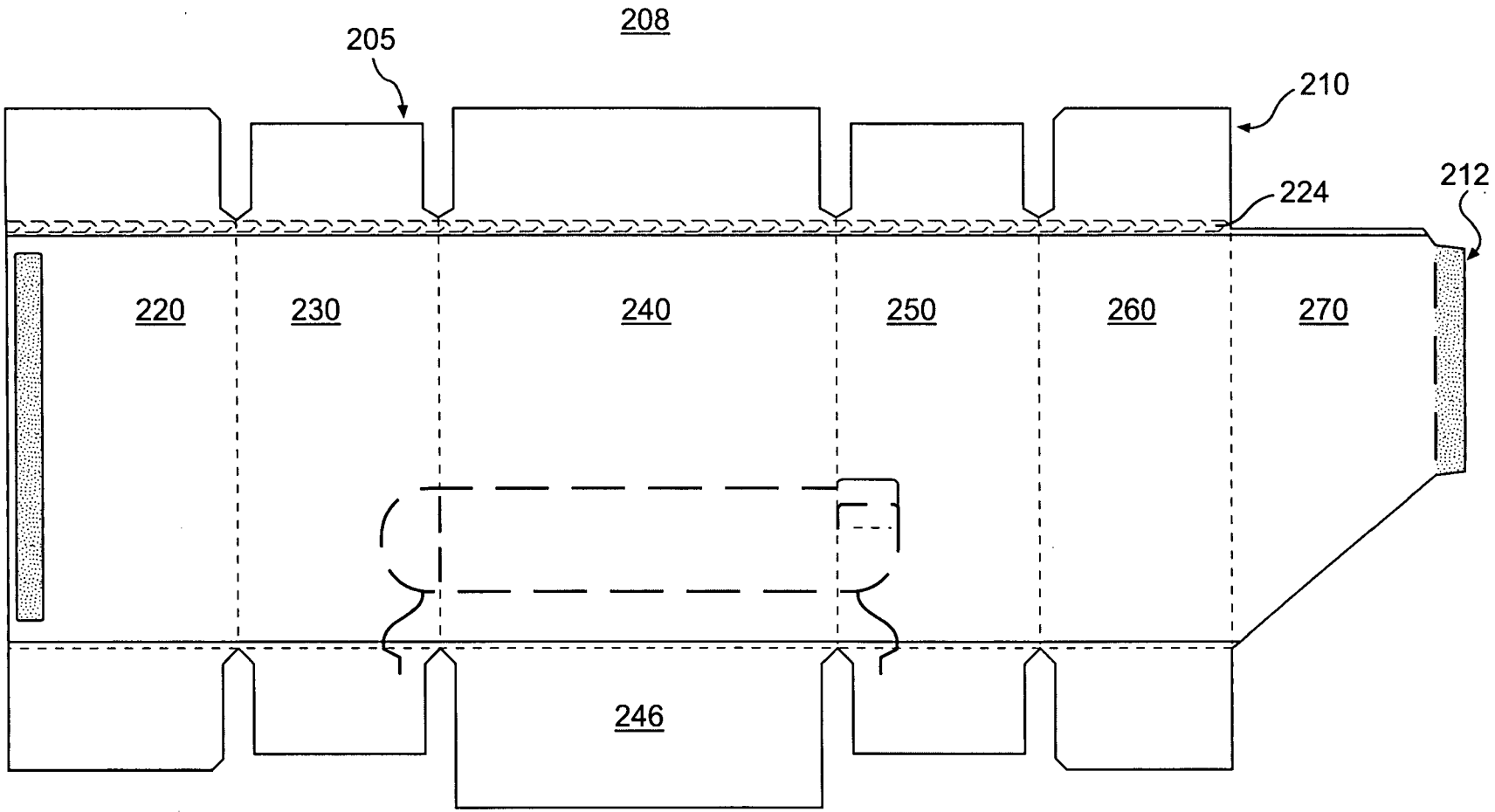
FIG. 9 is a plan view of a blank used to form a carton according to a second embodiment.
Figure 10:
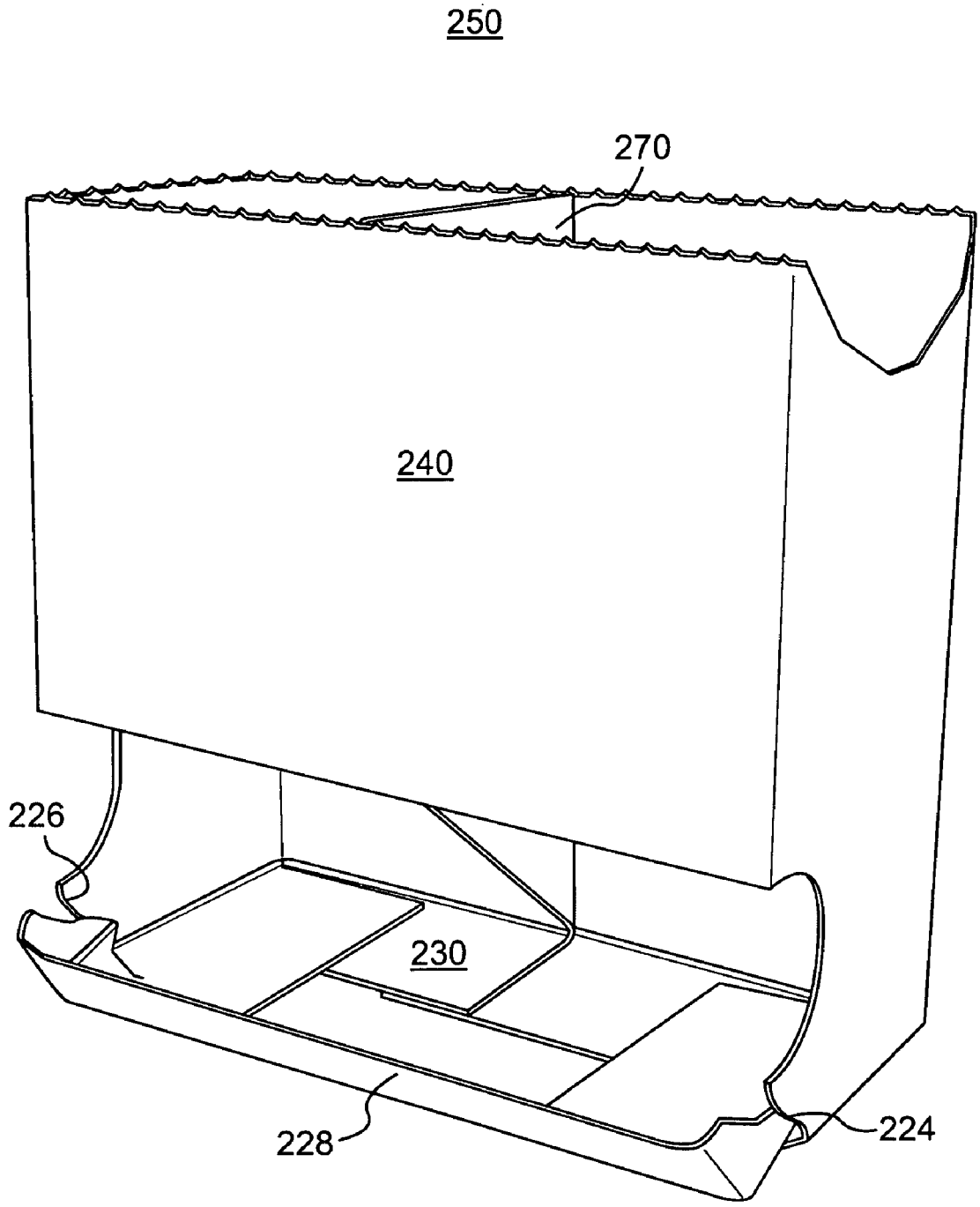
FIG. 10 is a perspective view of the second carton embodiment.

FIG. 9 is a plan view of a first, interior side 205 of a blank 208 used to form a carton 250 (illustrated in FIG. 10) according to a second embodiment. The blank 208 is substantially similar to the blank 8 illustrated in FIG. 1, and like elements in the two embodiments are indicated by like reference numbers, with reference numbers in FIGS. 9 and 10 being preceded by a '2'. The blank 208 includes a tear strip 224 extending along a top marginal portion of the blank, parallel to a top edge of the second sheet 212. Referring to FIG. 10, the tear strip 224 facilitates removal of the top panel of the erected carton 250. Also, the bottom flap 246 connected to the front panel 240 is longer than the bottom flap 46 shown in FIG. 1. The bottom flap 246 has a length such that it may extend from the front to the rear of the erected carton 250.

Figure 11A:
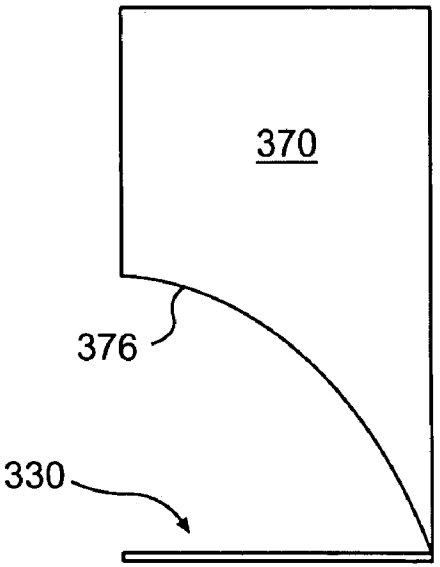
FIG. 11A is a partial section schematic view illustrating the relationship between an alternate divider panel and a bottom panel.

FIG. 11A is a partial section schematic view illustrating the relationship between an alternate divider panel 370 and a bottom panel 330. The divider panel 370 has a concave arcuate lower edge 376 which may be offset from the bottom panel 330.

Figure 11B:
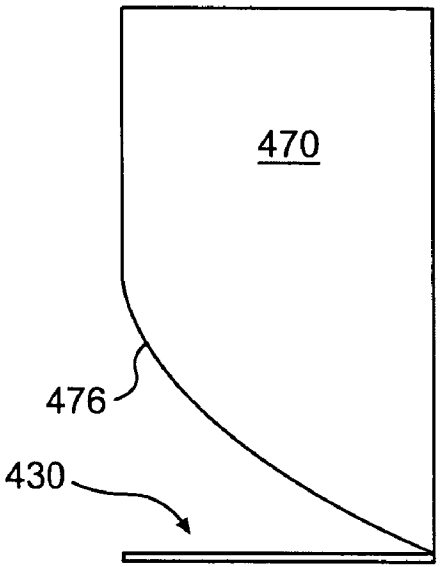
FIG. 11B is a partial section schematic view illustrating the relationship between a second alternate divider panel and a bottom panel.

FIG. 11B is a partial section schematic view illustrating the relationship between a second alternate divider panel 470 and a bottom panel 430. The divider panel 470 has a convex arcuate lower edge 476 which may be offset from the bottom panel 430.

Figure 11C:
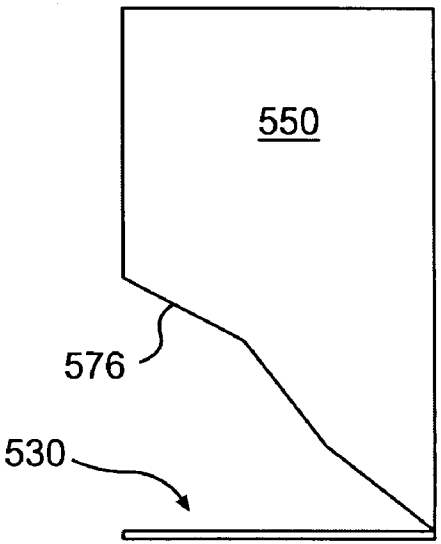
FIG. 11C is a partial section schematic view illustrating the relationship between a third alternate divider panel and a bottom panel.

FIG. 11C is a partial section schematic view illustrating the relationship between a third alternate divider panel 570 and a bottom panel 530. The divider panel 570 has a lower edge 576 formed from several linear segments. Each of the linear segments may be offset from the bottom panel 530.

In the above embodiments, the divider panels are substantially out of contact with the bottom panels of the erected cartons.

In accordance with the exemplary embodiments, the cartons may be constructed of paperboard, for example. The paperboard sheets used to form the blank may be thicker and heavier than ordinary paper. The blanks, and thus the cartons, can also be constructed of other materials, such as cardboard, or any other material having properties suitable for enabling the carton to function at least generally as described above. In the exemplary embodiments discussed above, the blanks are formed from coated solid unbleached sulfate (SUS) board. In general, the SUS board may have a caliper in the range of about 18-30. In one embodiment, the caliper is 26. The blanks can also be laminated to or coated with one or more sheet-like materials at selected panels or panel sections.

One or more panels of the blanks discussed above can be coated with varnish, clay, or other materials, either alone or in combination. The coating may then be printed over with product, advertising, and other information or images. The blanks may also be coated to protect any information printed on the blank. The blanks may be coated with, for example, a moisture barrier layer, on either or both sides of the blanks.

In accordance with the exemplary embodiments, a fold line can be any substantially linear, although not necessarily straight, form of weakening that facilitates folding thereal-ong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

For purposes of the description presented herein, the term "line of disruption" can be used to generally refer to either a cut line, a tear line, or a fold line formed in the material (or a combination of at least one cut line, tear line, or fold line)

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton, comprising:

a back panel having a first top edge;

a first side panel adjacent to the back panel;

a front panel adjacent to the first side panel and having a second top edge; a dispenser at least partially formed in the front panel;

a second side panel adjacent to the front panel and the back panel;

a bottom panel;

a top panel; and a divider panel disposed within an interior of the carton between the first and second side panels, wherein the divider panel connects the front panel to the back panel, the divider panel is generally parallel to the first side panel, the divider panel has a lower edge that is offset from the bottom panel, wherein the lower edge of the divider panel defines a relief area between the lower edge and the bottom panel, the lower edge extends between a lowermost point adjacent to the bottom panel and an uppermost point that is above or adjacent to a top edge of the dispenser and at least substantially all of the lower edge of the divider panel is out of contact with the bottom panel, the divider panel has a top edge that extends between and is at the same height as the first top edge and the second top edge, and the divider panel is foldably connected to the back panel by a fold line that is of substantially the same height as the back panel.

2. The carton of claim 1, wherein the dispenser extends across the front panel and into the first and second side panels.

3. The carton of claim 1, wherein the dispenser comprises a pivotable flap disposed adjacent to the bottom panel.

4. The carton of claim 3, wherein a top edge of the pivotable flap is pivotable outwardly away from the front panel.

5. The carton of claim 1, wherein the top edge of the divider panel is adjacent to the top panel.

6. The carton of claim 1, wherein the divider panel extends upwardly at an angle of at least five degrees away from the back panel and toward the front panel.

7. The carton of claim 1, wherein the lower edge of the divider panel is curved.

8. The carton of claim 1, wherein the lower edge of the divider panel comprises a plurality of linear segments.

9. The carton of claim 1, further comprising a tear strip extending around a perimeter of the carton adjacent to the top panel.

10. The carton of claim 1, wherein the back panel, the first side panel, the front panel, the second side panel, the bottom panel, and the top panel form a substantially parallelepipedal structure.

11. The carton of claim 1, wherein the carton is constructed from paperboard.

12. A carton, comprising:

a back panel having a first top edge;

a first side panel adjacent to the back panel;

a front panel adjacent to the first side panel and having a second top edge;

a second side panel adjacent to the front panel and the back panel;

a bottom panel adjacent to the back panel, the first side panel, the front panel and the second side panel;

a top panel adjacent to the back panel, the first side panel, the front panel and the second side panel;

a dispenser at least partially formed in a lower portion of the front panel; and a divider panel disposed within an interior of the carton between the first and second side panels and dividing the interior of the carton into two columns, wherein the divider panel is adjacent to the top panel and connects the front panel to the back panel, the divider panel is generally parallel to the first side panel, the divider panel has a lower edge that is offset from the bottom panel and at least substantially all of the lower edge of the divider panel is out of contact with the bottom panel, the divider panel has a top edge that extends between and is at the same height as the first top edge and the second top edge, and the lower edge of the divider panel defines a relief area between the divider panel and the bottom panel, the lower edge extends between a lowermost point adjacent to the bottom panel an uppermost point above or adjacent to a top edge of the dispenser.

13. The carton of claim 12, wherein the dispenser extends across the front panel and into the first and second side panels.

14. The carton of claim 12, wherein the divider panel is foldably connected to the back panel at a fold line that is of substantially the same height as the back panel.

15. The carton of claim 14, wherein the lower edge extends upwardly at an angle of at least five degrees away from the lowermost point to the uppermost point.

16. The carton of claim 14, wherein the lower edge of the divider panel is curved.

17. The carton of claim 14, wherein the lower edge of the divider panel comprises a plurality of linear segments.

18. The carton of claim 12, wherein the carton is constructed from paperboard and the lower edge extends across an entire width of the divider panel.

19. A carton blank, comprising:

at least one back panel having a first top edge at a first marginal portion of the blank;

a first side panel;

a front panel having a second top edge at the first marginal portion of the blank; a dispenser cut pattern at least partially formed in the front panel;

a second side panel;

at least one top flap extending along the first marginal portion of the blank;

at least one bottom flap extending along a second marginal portion of the blank and foldably connected to a remainder of the blank at a bottom fold line; and a divider panel, wherein the divider panel has a lower edge that extends away from the bottom fold line towards the first marginal portion of the blank, wherein the divider panel is foldably connected to the at least one back panel by a back fold line that is of substantially the same height as the back panel, the divider panel is for being generally parallel to the first side wall when the blank is formed into a carton, the divider panel has a top edge extending across the entire width of the divider panel that is aligned with the first top edge and the second top edge such that the height of the divider panel is substantially equal to the height of the at least one back panel and the front panel, wherein in a carton formed from the blank, the at least one back panel, the first side panel, the front panel, the second side panel, the bottom panel, and the top panel form a parallelepipedal structure, the at least one bottom flap extending along the second marginal portion of the blank forms a bottom panel, the divider panel connects the front panel to the back panel, and the lower edge of the divider panel is offset from the bottom panel wherein at least substantially all of the lower edge of the divider panel is out of contact with the bottom panel.

20. The blank of claim 19, further comprising an adhesive flap foldably connected to the divider panel.

21. The blank of claim 19, wherein the blank comprises a first sheet and a second sheet overlapping the first sheet.

22. A carton blank, comprising:

a first side panel;

a front panel foldably connected to the first side panel and having a first top edge at a first marginal portion of the blank;

a second side panel foldably connected to the front panel;

at least one back panel having a second top edge at the first marginal portion of the blank;

a divider panel foldably connected to the at least one back panel, wherein the divider panel is generally parallel to the first side panel in a carton formed from the blank, the divider panel having a top edge extending across the entire width of the divider panel and that is aligned with the first top edge and the second top edge such that the height of the first divider panel is substantially equal to the height of the at least one back panel and the front panel;

at least one top flap extending across the first marginal portion of the blank and foldably connected at a first longitudinal fold line;

a dispenser at least partially formed in the front panel; and at least one bottom flap extending across a second marginal portion of the blank and foldably connected at a second longitudinal fold line, wherein the divider panel has a lower edge that extends between a first point adjacent to the at least one back panel and the second longitudinal fold line at the second marginal portion of the blank, and a second point spaced apart from the second marginal portion of the blank, wherein in a carton formed from the blank, the at least one back panel, the first side panel, the front panel, the second side panel, the bottom panel, and the top panel form a parallelepipedal structure, the at least one flap extending along a second marginal portion of the blank forms a bottom panel, the divider panel connects the front panel to the back panel, and the lower edge of the divider panel is offset from the bottom panel to define a relief area between the divider panel and the bottom panel wherein at least substantially all of the lower edge of the divider panel is out of contact with the bottom panel.

23. The blank of claim 22, wherein the blank is constructed from paperboard.

24. The blank of claim 23, wherein the blank comprises a first sheet and a second sheet overlapping the first sheet.

25. A substantially parallelepipedal paperboard carton, comprising:

a first back panel;

a second back panel connected to the first back panel the connected first and second back panels having cooperating top edges that form a first top edge;

a first side panel foldably connected to the first back panel;

a front panel adjacent to the first side panel and having a second top edge;

a second side panel adjacent to the front panel and foldably connected to the second back panel;

a bottom panel adjacent to the first and second back panels, the first and second side panels, and the front panel;

a top panel adjacent to the first and second back panels, the first and second side panels, and the front panel;

a dispenser at least partially formed in a lower portion of the front panel; and a divider panel disposed within an interior of the carton between the first and second side panels and dividing the carton interior into vertical columns, wherein the divider panel is foldably connected to one of the first back panel and the second back panel, the divider panel is generally parallel to the first side panel, a top edge of the divider panel is adjacent to the top panel and extends between and is at the same height as the first top edge and the second top edge, the divider panel has a lower edge that is offset from the bottom panel wherein at least substantially all of the lower edge of the divider panel is out of contact with the bottom panel, and the lower edge of the divider panel defines a relief area between the divider panel and the bottom panel, the lower edge extends between a lowermost point adjacent to the bottom panel an uppermost point above or adjacent to a top edge of the dispenser.

26. The carton of claim 25, wherein the top edge of the divider panel is of substantially the same height as the carton.

27. The carton of claim 1, wherein the lower edge extends across an entire width of the divider panel.

28. The blank of claim 22, wherein the first point corresponds to a location wherein the divider panel has a maximum height and the second point corresponds to a location wherein the divider panel has a minimum height.

29. The carton of claim 12, wherein the bottom panel forms a bottom exterior surface of the carton.

* * * * *